US005906143A

United States Patent [19]

Yuen

[11] Patent Number: 5,906,143

[45] Date of Patent: May 25, 1999

[54] INK CARTRIDGE OPENER

[76] Inventor: Kenneth Yuen, 1613 Chelsea Rd., San Marino, Calif. 91108

[21] Appl. No.: 08/700,223

[22] Filed: Aug. 20, 1996

Related U.S. Application Data

[63] Continuation-in-part of application No. 08/233,359, Apr. 26, 1994, Pat. No. 5,546,830.

[51] Int. Cl.[6] ..... B47B 7/92

[52] U.S. Cl. ..... 81/3.39; 241/99; 225/104; 29/239

[58] Field of Search ..... 81/3.27, 3.37, 81/3.39, 3.55, 3.08, 3.31, 3.32, 3.36, 3.29, 3.44, 3.56, 3.57; 254/113, 120, 131; 29/801, 239; 225/93, 96.5, 103, 104; 241/99

[56] References Cited

U.S. PATENT DOCUMENTS

| | | | |
|---|---|---|---|
| 2,057,614 | 10/1936 | Girard | 81/3.36 |
| 2,554,948 | 5/1951 | Kiefer | 81/3.32 |
| 2,876,665 | 3/1959 | Lecours | 81/3.08 X |
| 3,404,593 | 10/1968 | Arcarose et al. | 241/99 X |
| 3,828,976 | 8/1974 | Sidelinker | 241/99 X |
| 4,708,033 | 11/1987 | Eash | 81/3.37 |
| 5,129,566 | 7/1992 | Ogden et al. | 225/103 X |
| 5,551,643 | 9/1996 | Chapin | 241/99 |

*Primary Examiner*—D. S. Meislin
*Attorney, Agent, or Firm*—Merchant, Gould, Smith, Edell, Welter & Schmidt

[57] ABSTRACT

An ink cartridge opener for use in connection with a flat support surface is provided. The opener includes a cartridge holder adapted to hold a first portion of an ink cartridge. Opening means with the cartridge holder is provided for applying force to a second portion of the ink cartridge. The cartridge holder is formed of separable first and second cartridge holder components. The opening means is a handle arm captured at a pivot point by the first and second cartridge holder components.

12 Claims, 5 Drawing Sheets

INK CARTRIDGE OPENER

CROSS-REFERENCE TO RELATED APPLICATION

This is a continuation-in-part of Ser. No. 08/233,359, filed Apr. 26, 1994, now U.S. Pat. No. 5,546,830.

TECHNICAL FIELD

The present invention relates to office supplies, and more particularly to a manufactured product designed to separate the parts of an ink cartridge for a computer printer.

BACKGROUND ART

Computer printers use a number of different techniques for applying ink to the paper. Many printers use a conventional typewriter ribbon, while other printers use thermal heads, and still others use lasers. One common species of computer printer uses ink jets, and the present invention is directed to a device for efficiently utilizing ink jet printers.

While ink jet printers have many advantages, one significant disadvantage is that the print head and ink reservoir are typically contained in a single disposable unit. For example, Hewlett-Packard of Vancouver, Wash., U.S.A. manufactures a line of ink jet printers that have disposable combination print head/ink reservoir cartridges. While the cartridges are of excellent quality, the requirement that a print head be supplied with each cartridge makes the cartridges unduly expensive. The useful life of a print head is many times the length of printing time provided by the ink reservoir, and thus a significant waste is incurred every time a spent cartridge is replaced simply because the ink has run out.

In addition, there are multicolor print cartridges that have three primary colors in separate reservoirs in each cartridge. Since it is rare that all three colors will simultaneously be spent, it is not unusual to throw away perfectly good cartridges having substantial supplies of two colors, but being empty for the third color.

For whatever reason, the manufacturers of the combination print head/ink reservoir cartridges have not seen fit to provide a way for the user to replenish the ink within the cartridges. In fact, the cartridges as presently supplied by, for example, Hewlett-Packard, have sonically welded cartridge halves that cannot be easily separated to enable reassembly after refilling one or more of the ink reservoirs inside.

Refilling ink cartridges with ink is a two-step process. First, some means must be provided to break open the cartridges, such as the ink cartridge opener described in my U.S. Pat. No. 5,546,830, the disclosure of which is herein incorporated by reference. Then, the reservoir must be refilled.

One drawback of prior ink cartridge openers is the lack of firm gripping of the cartridge during the somewhat delicate procedure of separating the top and bottom portions of the ink cartridge. In the opener described in my prior U.S. Pat. No. 5,546,830 base stand is configured to hold the cartridge vertically and upside down, applying opening force to the bottom of the cartridge while gripping the top portion in the base stand. While this has been an effective apparatus for opening cartridges, I have developed an improved ink cartridge opener with enhanced gripping and stability features described below. In addition, my improved opener has manufacturing advantages which will be described.

Thus, there presently exists a need for a device to enable the efficient and fool-proof separation of housing parts for an ink jet printer cartridge, such that internal ink reservoirs may be replenished and the cartridge reassembled for renewed use. The device should provide a simple and inexpensive ink cartridge opener that is efficient in manufacturing requirements and provides a solid grip on the printer ink cartridge during the opening procedure.

SUMMARY OF THE DISCLOSURE

An ink cartridge opener is provided. The opener includes a cartridge holder adapted to hold a first portion of an ink cartridge. Opening means with the cartridge holder is provided for applying force to a second portion of the cartridge. The cartridge holder is formed of first and second cartridge holder components joined with dowel pins. The opening means is a handle arm captured at a pivot point by the first and second cartridge holder components.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 3:
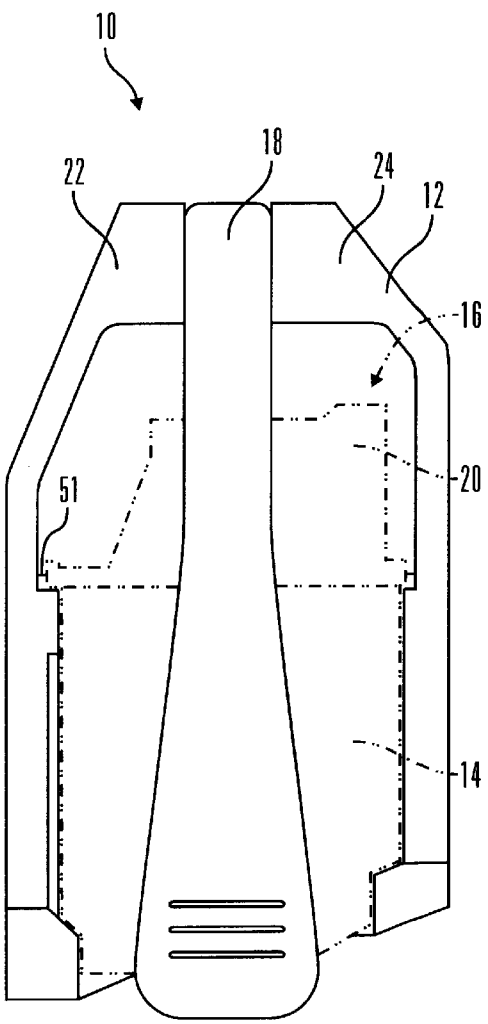
FIG. 3 is a view similar to FIGS. 1 and 2 with an ink cartridge in place.
Figure 2:
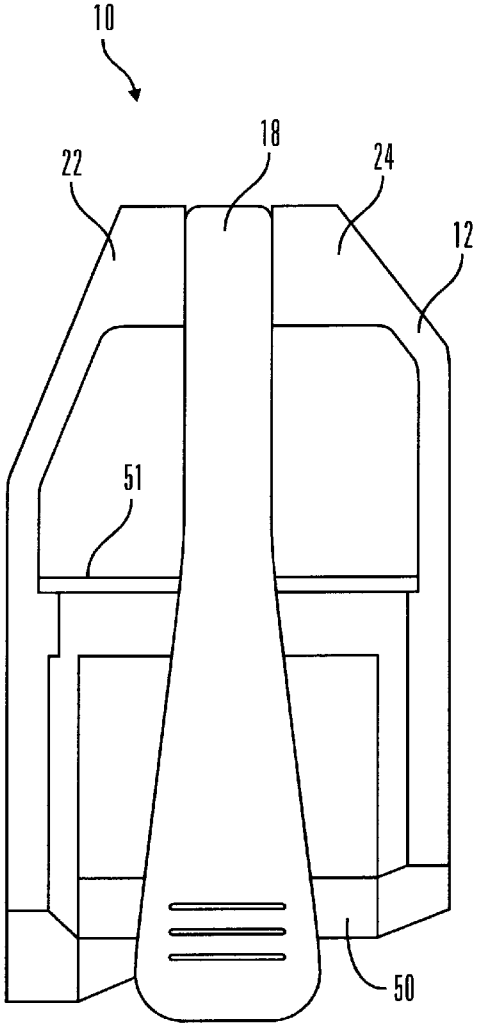
FIG. 2 is a view similar to FIG. 1 with the opener handle installed.
Figure 1:
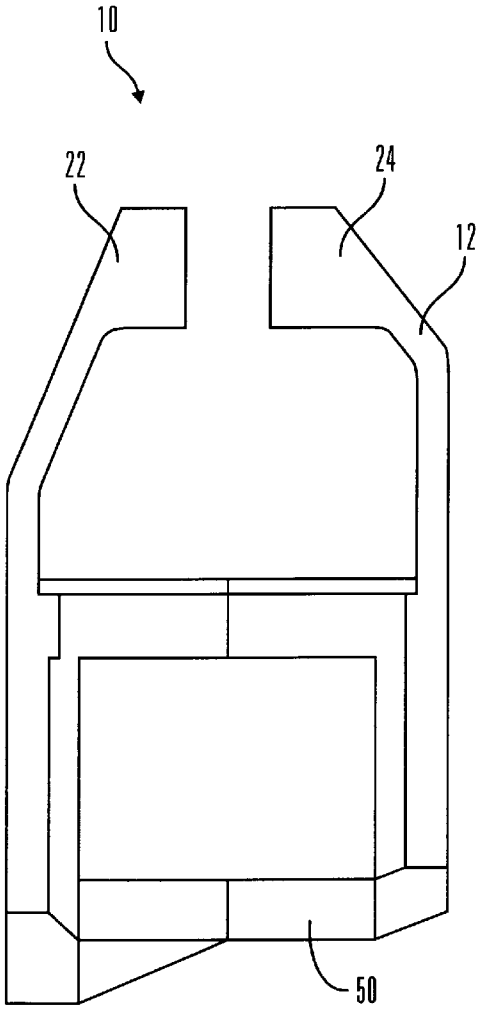
FIG. 1 is a top view of the apparatus with the opener handle removed for clarity.

Referring initially to FIGS. 1–3, ink cartridge opener 10 includes a cartridge holder 12 adapted to hold a first portion 14 of an ink cartridge 16. Opening means 18 with the cartridge holder 12 is provided for applying force to a second portion 20 of the ink cartridge. The cartridge holder 12 is formed of separable first and second cartridge holder components 22, 24. Preferably, the cartridge holder is adapted and arranged to hold the more massive, larger, bottom portion of an ink cartridge such as the one illustrated, which those skilled in the art will recognize as a popular Hewlett-Packard ink jet cartridge. Also, while the cartridge opener 10 is illustrated as one that is usable with a flat support surface, it will be recognized that the opener can be made in the form of a pliers or nutcracker device that is entirely hand-held during operation.

Referring now to FIGS. 4–12, in addition to FIGS. 1–3, the first cartridge holder component 22 is joined to the second cartridge holder component 24 by way of dowel pins (not shown) that are inserted into dowel pin openings 30 on first cartridge holder component 22 and dowel pin openings 32 on second cartridge holder component 24. The dowel pins are sized to provide a secure fit between the first and second cartridge holder components 22,24. This method of construction enables the sturdy construction of the device from precision injection molded parts. The handle 18 has a pair of opposed pivot pins 34 that are captured at pivot point openings 36 on first cartridge holder component 22 and pivot point openings 38 on second cartridge holder component 24. As best shown in FIGS. 1 and 2, the pivot point openings are separated, and the pivot pins 34 provide pivot points for rotation of handle 18. In this manner, the handle 18 operates as a pivot member which is pivotally coupled to the cartridge holder components 22 and 24 and is pivotal relative to those components between at least first and second pivot positions. Handle 18 includes a contact point 40 located intermediate of the pivot pins 34 and a push pad 42 at the opposite end of handle 18. The push pad 42 provides a surface on which an external force may be received and transferred to the contact point 40, as a lateral force on one portion 20 of an ink cartridge received by the cartridge holder components 22, 24, wherein the lateral force is directed from one side of the cartridge towards the opposite side of the cartridge, as shown in FIGS. 13–16. Lever magnification of force provided by the described configuration of handle 18 allows the even, slow application of force to the printer ink cartridge.

Figure 6:
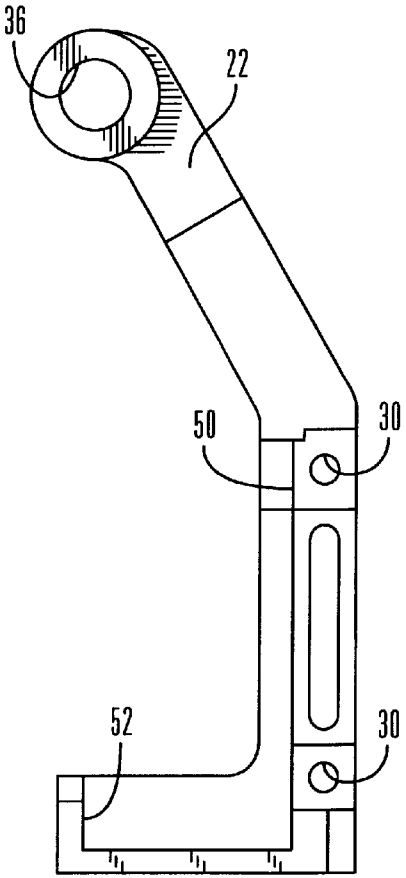
FIG. 6 is an inside view of the first cartridge holder component.
Figure 5:
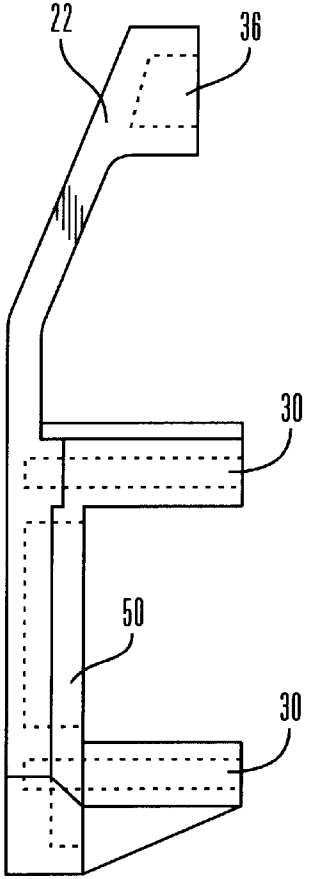
FIG. 5 is a top view of the first cartridge holder component.
Figure 4:
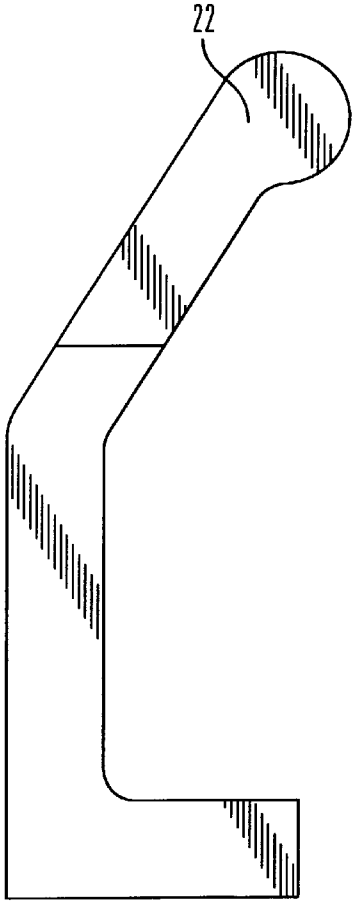
FIG. 4 is a side view of the first component of the cartridge holder.
Figure 9:
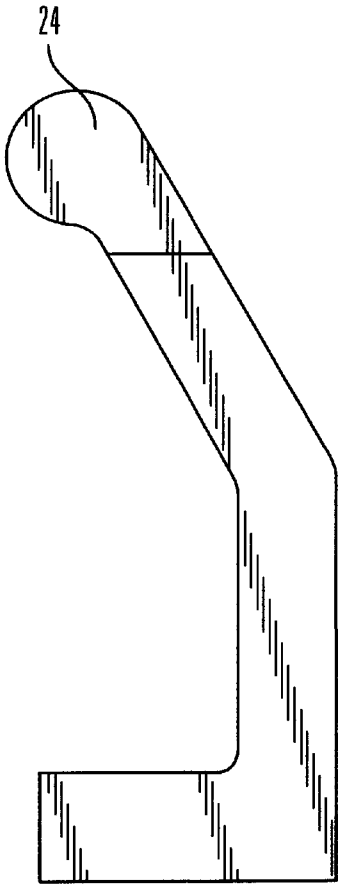
FIG. 9 is a side view of second cartridge holder component.
Figure 8:
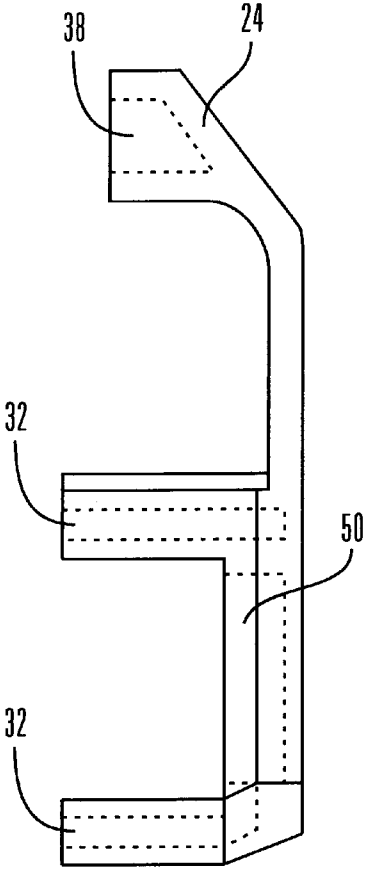
FIG. 8 is a top view of the second cartridge holder component.
Figure 7:
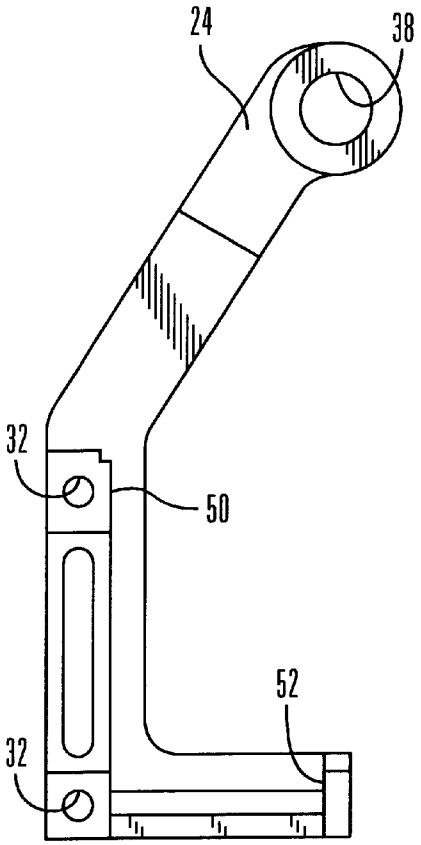
FIG. 7 is an inside view of the second component of the cartridge holder.
Figure 10:
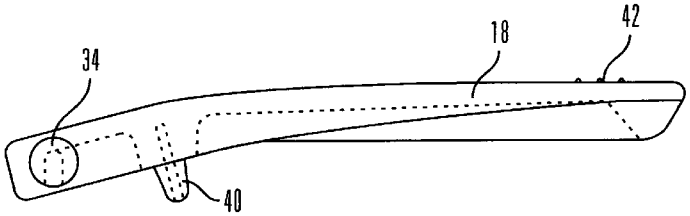
FIG. 10 is a side view of the handle.
Figure 11:
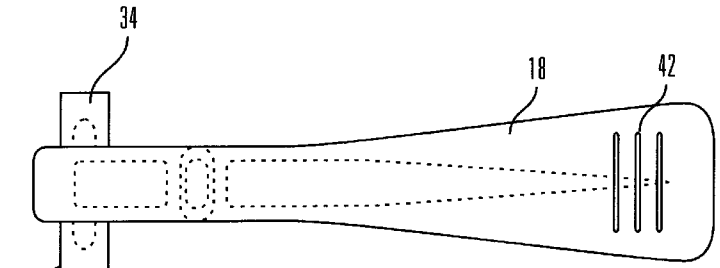
FIG. 11 is a top view of the handle.
Figure 12:
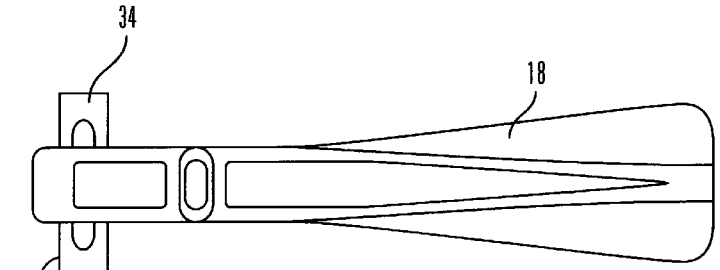
FIG. 12 is a bottom view of the handle.
Figure 14:
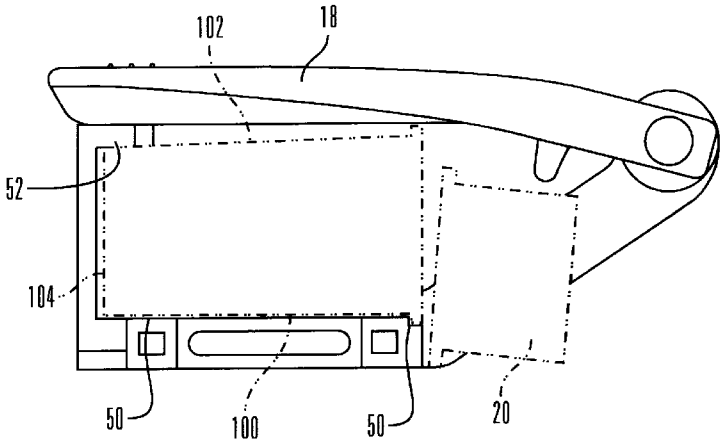
FIGS. 13–16 are schematic views of the apparatus in operation.
Figure 16:
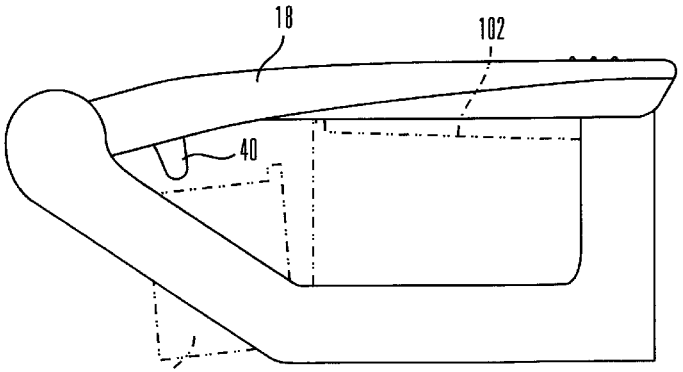

The cartridge holder 12 has widely-separated cartridge support surfaces 50 for supporting the ink cartridge 16 along its longest and widest dimensions. As best shown in FIGS. 5–8, the cartridge support surfaces are parallel. The cartridge support surface 50 defines an edge 51 (FIGS. 2 and 3) for positioning adjacent the ink cartridge, with a first portion 14 of the ink cartridge abutting the cartridge support surface 50 and the second portion 20 of the ink cartridge extending beyond the support surface edge 51, as shown in FIG. 3. The edge 51 is disposed intermediate the remainder of the support surface 50 and the pivot point of the handle 18, as best shown in FIG. 2. It will be recognized, however, that the lever action applied to the second portion of the ink cartridge would cause the ink cartridge to pivot in reaction thereto unless the ink cartridge is stabilized, thus, the cartridge holder 12 further includes cartridge stabilizing surfaces 52, as best shown in FIGS. 6 and 7. As illustrated in FIG. 3, the cartridge stabilizing surfaces provide a firm grip on an upper portion of the ink cartridge first portion, such that movement of the ink cartridge first portion is prevented when force is applied to the second portion.

Figure 13:
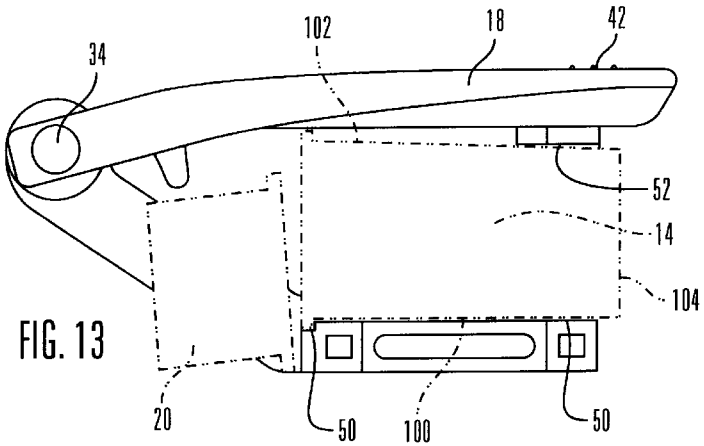
Figure 15:
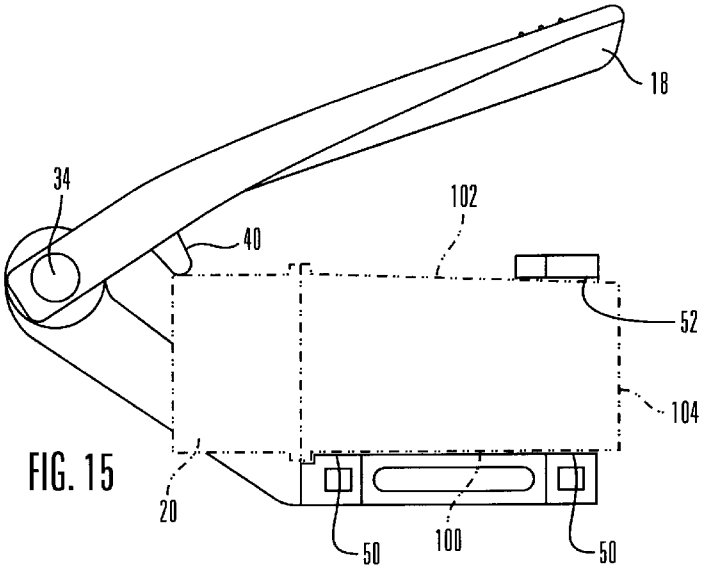

In operation, as best shown in FIGS. 13–16, the ink cartridge first portion 14 is firmly gripped on cartridge support surfaces 50 by way of cartridge stabilizing surfaces 52 when force is applied to second portion 20. Cartridge support surfaces 50 are parallel to and contact the ink cartridge first portion 14 along its longest and widest dimensions. In other words, the ink cartridge is supported along its largest and most massive face 100. Stabilizing surfaces 52 contact the first portion 14 on the face 102 opposite the face 100 supported by cartridge support surfaces 50, and at the end 104 of first portion 14 opposite second portion 20. The handle 18 is pivoted to place the contact point 40 in contact with the second portion 20 of an ink cartridge received on the cartridge support surfaces 50, as shown in FIG. 15. By applying a sufficient lateral force with the contact point 40 of the handle 18 on the second portion of the ink cartridge, along one cartridge side, in the direction toward the opposite cartridge side, the second portion 20 becomes disconnect from the first portion 14 of the ink cartridge, as shown in FIG. 13.

Whereas, the present invention has been described with the respect to a specific embodiment thereof, it will be understood that various changes and modifications will be suggested to one skilled in the art, and it is intended to encompass such changes and modifications as fall within the scope of the appended claims.

I claim:

1. An ink cartridge opener, comprising:

a cartridge holder adapted to hold a first portion of an ink cartridge;

opening means with the cartridge holder for applying force to a second portion of the ink cartridge;

the cartridge holder being formed of first and second cartridge holder components joined by pins; and the opening means being a handle arm being captured at a pivot point by the first and second cartridge holder components.

2. The opener of claim 1, with the cartridge holder having cartridge support surfaces for supporting the ink cartridge, the cartridge support surfaces being parallel and adapted to hold the ink cartridge first portion along a face having its longest and widest dimensions.

3. The opener of claim 2 with the cartridge holder further having cartridge stabilizing surfaces for preventing movement of the ink cartridge first portion when force is applied to the second portion.

4. An ink cartridge opening system including:

an ink cartridge having first and second connected cartridge portions which, when connected, define a cartridge for containing ink having at least two opposite facing cartridge sides; and an ink cartridge opener comprising:

a cartridge holder member receiving the first portion of the ink cartridge and having a cartridge support surface which abuts the first cartridge portion along a first one of said two opposite facing cartridge sides, to hold the first cartridge portion, but not the second cartridge portion, against a lateral force directed from a second one of said two opposite facing cartridge sides;

a pivot member pivotally coupled to the cartridge holder member, said pivot member being pivotal relative to the cartridge holder member between at least first and second pivot positions;

said pivot member having a contact member;

wherein the first cartridge portion is located intermediate the contact member and the cartridge support surface; and wherein said contact member contacts the second portion of the ink cartridge, along the cartridge side opposite to the cartridge side abutting the cartridge support surface of the cartridge holder member, when the pivot member is in said second pivot position; and said pivot member further having a handle surface for receiving an external force and for transferring the force to the contact member as a lateral force on the second portion of the ink cartridge, directed from the second side of the cartridge toward the first side of the cartridge, sufficient to disconnect the second portion from the first portion of the ink cartridge, upon the handle being in the second pivot position.

5. An ink cartridge as recited in claim 4, wherein said cartridge holder member further comprises a cartridge stabilizing surface abutting the first cartridge portion along the second side of the ink cartridge.

6. An ink cartridge as recited in claim 4, wherein said cartridge support surface defines an edge and wherein the second portion of the ink cartridge extends beyond said support surface edge.

7. An ink cartridge opener as recited in claim 4, wherein said contact member is located intermediate said handle surface and a pivot coupling point of the pivot member.

8. A method of opening an ink cartridge of the type having first and second connected cartridge portions which, when connected, define a cartridge for containing ink having at least two opposite facing cartridge sides, said method using a cartridge opener having a cartridge holding member and a pivot member pivotally coupled to the cartridge holding member, the cartridge holding member provided with a cartridge support surface for receiving an ink cartridge and positioned to abut the first cartridge portion, along a first one of said two opposite facing cartridge sides, to hold the first cartridge portion, but not the second cartridge portion against a lateral force directed from a second one of said two opposite facing cartridge sides, the method comprising:

supporting the first portion of an ink cartridge along the first one of said two opposite facing cartridge sides, with said cartridge support surface;

pivotally moving the pivot member relative to the cartridge holder member, to a position in contact with the second cartridge portion of the ink cartridge, along the second one of said two opposite facing cartridge sides; and applying a lateral force with the pivot member on the second portion of the ink cartridge, along the second cartridge side, in the direction toward the first cartridge side, sufficient to disconnect the second portion from the first portion of the ink cartridge.

9. A method as recited in claim 8, wherein said cartridge holder member further comprises a cartridge stabilizing surface and said method further comprises abutting the first cartridge portion along the second side of the ink cartridge with said cartridge stabilizing surface, upon receipt of a first portion of the ink cartridge by the cartridge holder member.

10. A method as recited in claim 8, wherein said cartridge support surface defines an edge and wherein said step of supporting comprises extending the second portion of the ink cartridge beyond said support surface edge.

11. A method as recited in claim 8, wherein said pivot member includes a handle surface and wherein said step of applying a lateral force comprises pressing the handle surface in the direction toward the support surface of the cartridge holding member.

12. A method of opening an ink cartridge of the type having first and second connected cartridge portions, using a cartridge opener having a cartridge holding member configured to receive and hold the first cartridge portion against a lateral force and a handle member pivotally coupled to the cartridge holding member, the method comprising:

receiving said first cartridge portion of an ink cartridge in a cartridge holder member;

pivotally moving the handle member relative to the cartridge holder member, to a position in contact with the second cartridge portion of the ink cartridge;

applying a lateral force with the handle member on the second portion of the ink cartridge sufficient to disconnect the second portion from the first portion of the ink cartridge, while the first portion of the ink cartridge is received by the cartridge holder member.

* * * * *